US005501261A

United States Patent [19]

Peale

[11] Patent Number: 5,501,261

[45] Date of Patent: Mar. 26, 1996

[54] WINDOW TREATMENT OPERATING MECHANISM

[76] Inventor: Robert G. Peale, 3137 Collingswood Dr., Cameron Park, Calif. 95682

[21] Appl. No.: 323,827

[22] Filed: Oct. 17, 1994

[51] Int. Cl.[6] ..... E06B 9/30

[52] U.S. Cl. ..... 160/168.1; 160/172; 160/174

[58] Field of Search ..... 160/168.1 R, 168.1 V, 160/172 R, 172 V, 173 R, 173 V, 174 R, 174 V, 177 R, 177 V; 16/87 R, 87.4 R, 93 R

[56] References Cited

U.S. PATENT DOCUMENTS

| | | | |
|---|---|---|---|
| 1,878,186 | 9/1932 | Rudolph | 160/172 R |
| 1,933,709 | 11/1933 | Cooper | 156/17 |
| 2,422,407 | 6/1947 | Green | 160/172 V |
| 2,827,113 | 3/1958 | Graham | 160/172 |
| 3,153,819 | 10/1964 | Bond | 20/56.5 |
| 3,853,169 | 12/1974 | Music et al. | 160/172 R |
| 4,103,727 | 8/1978 | Spohr | 160/172 VX |
| 4,187,897 | 2/1980 | Frentzel | 160/172 RX |
| 4,291,738 | 9/1981 | Grenga et al. | 160/172 VX |
| 4,759,397 | 7/1988 | Walther | 160/177 V |
| 4,834,163 | 5/1989 | Dickstein | 160/177 VX |

*Primary Examiner*—Philip C. Kannan
*Attorney, Agent, or Firm*—Jack C. Munro

[57] ABSTRACT

An operating mechanism for a window treatment where the window treatment utilizes a plurality of sheet material louvers. The operating mechanism can be used when the louvers are mounted in a vertical direction or a horizontal direction. The operating mechanism in each case includes a support device for each louver which is mounted in conjunction with an elongated guide track. The support device includes a sleeve with a connecting stud of its respective louver to be secured to this sleeve. Integrally mounted on and extending transversely of the sleeve is a transverse arm. A connecting cord assembly is to be mounted in connection with the transverse arms of each of the support devices of the guide track. Manipulation of the cord assembly is for the purpose of pivoting each of the support devices and thereby pivoting each of the louvers from an aligned position, where the louvers combine to form a structure similar to a solid panel, and a parallel position forming large spaces between the louvers, forming a structure similar to an open window.

7 Claims, 2 Drawing Sheets

Fig. 3.
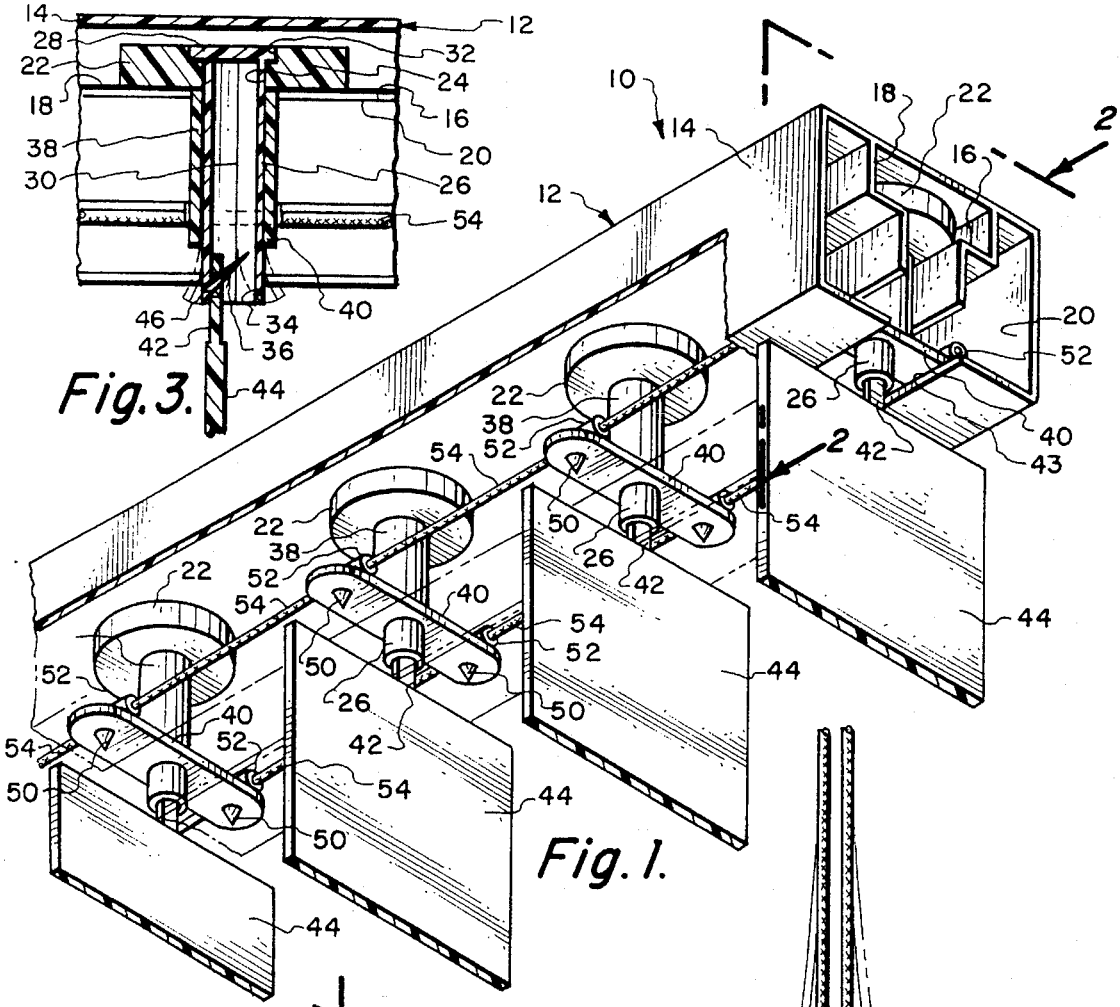
Fig. 1.
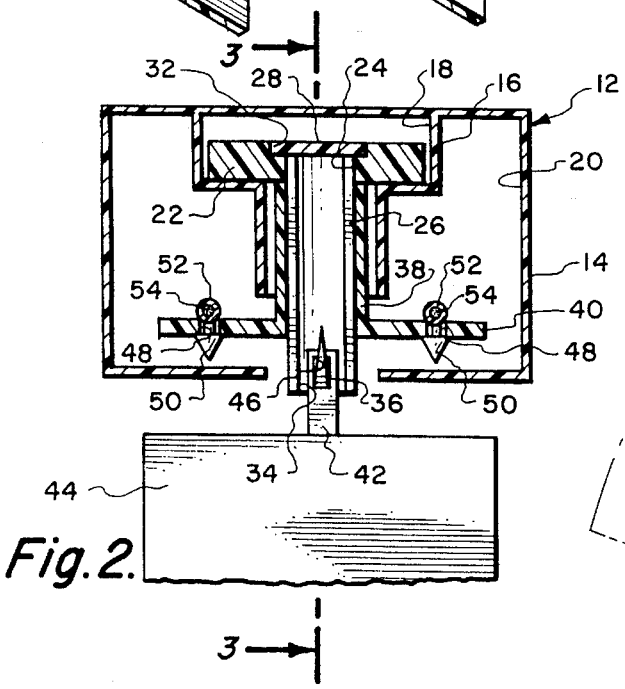
Fig. 2.
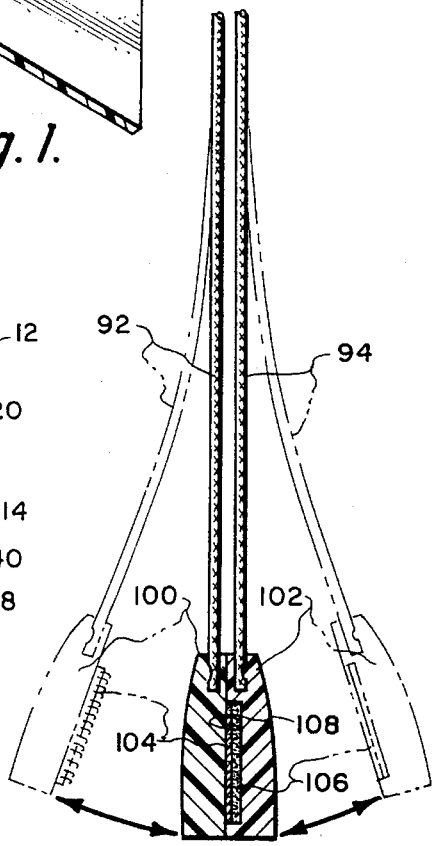
Fig. 7.

WINDOW TREATMENT OPERATING MECHANISM

BACKGROUND OF THE INVENTION

1. Field of the Invention

The field of this invention relates to an improved operating mechanism for a window treatment and in particularly to a window treatment which is constructed of a plurality of closely spaced sheet material louvers which are supported from a frame mounted in conjunction with a window.

2. Description of the Prior Art

Window treatments for houses and buildings are in exceedingly common use. A common form of a window treatment utilizes a series of louvers with each louver composed of a thin, sheet material, narrow panel. In some window treatments these louvers are arranged vertically and the window treatment is defined as a vertical. In other window treatments the louvers are arranged horizontally and are referred to either as a blind or shutter.

Blinds are commonly constructed with a few different mechanisms to operate the blind. Shutters are constructed with a different type of mechanism. Verticals are yet again constructed using a different type of mechanism. In the past, it has not been known to design a single type of mechanism that could be utilized in conjunction with all three different types of window treatments.

Additionally, the mechanisms that have been designed in the past to be used in conjunction with the blinds, shutters and verticals have been quite complex in construction by being composed of a multitude of different parts. Inherently, these mechanisms are expensive to manufacture and therefore expensive for the consumer to purchase. Also, such mechanisms in the past have been prone to breakage and also prone to inoperability due to deterioration over a period of years. Also, because of the number of parts involved in and with the prior art mechanisms, a significant amount of assembly is required by the installer thereby increasing the cost of installation.

SUMMARY OF THE INVENTION

An operating mechanism for a window treatment which utilizes a plurality of sheet material louvers. Within a shutter or blind type of window treatment there is to be mounted a pair of guide tracks with each guide track being mounted at each side of the window. Within a vertical type of window treatment, there is utilized only a single guide track and that is located at the top of the window. Within each guide track there is to be located a series of support devices with each support device to connect to a louver. Within the vertical type of window treatment, each support device also includes a guide roller that is not necessary within the blind or shutter type of window treatment. Each support device includes a transverse arm with the transverse arms of the series of support devices within an elongated guide track being connected together by a cord assembly composed of a pair of cords mounted on opposite ends of the arm. Manual operation of the cord exteriorly of the guide track will cause the support devices to pivot and thereby pivot the louvers between an aligned position and a parallel position. Direct pivoting of a single louver will also cause all the louvers to pivot. A separate pull cord assembly can be mounted in conjunction with the support devices of a blind or shutter whose function is to move the support devices in an abutting location as opposed to the normal spaced apart location. The pull cord assembly is composed of two separate cords with each cord being connected to one half of a handle, with this handle being normally connected together by a releasable fastener arrangement.

One of the objectives of the present invention is to construct an operating mechanism that can be utilized in conjunction with a plurality of different types of window treatments.

Another objective of the present invention is to construct an operating mechanism which is composed of few parts thereby minimizing manufacturing costs and assembly.

Another objective of the present invention is to construct a window treatment that is highly saleable and profitable to the installing dealer, facilitating installation.

Another objective of the present invention is to create a window treatment that aesthetically looks to be a high quality product.

Another objective of the present invention is to construct a window treatment which when mounted on the window has a clean, unobstructed look to the window taking up little space in conjunction with the window.

Another objective of the present invention is to construct a window treatment that is durable and will look good even after years of use.

Another objective of the present invention is to construct a window treatment that will be easy to clean.

Another objective of the present invention is to construct a window treatment that is designed to either eliminate or minimize the use of head rails, bottom rails, frames, tilt bars and cords for operating the window treatment thereby leaving the window unencumbered. This allows for a cleaner, more attractive window treatment, a fuller view through the window, all with consumer-preferred shutter-style louvers.

BRIEF DESCRIPTION OF THE DRAWINGS

FIG. 1 is an isometric view of a portion of a vertical type of window treatment utilizing the operating mechanism of the present invention;

FIG. 2 is a cross sectional view taken along line 2—2 of FIG. 1;

FIG. 3 is cross sectional view taken along line 3—3 of FIG. 2 depicting the installation procedure of one louver in conjunction with its support device of the operating mechanism;

FIG. 7 is a cross sectional view through the pull cord assembly utilized in conjunction with the blind of FIG. 4 taken along line 7—7 of FIG. 5.

DETAILED DESCRIPTION OF THE PREFERRED EMBODIMENT

Figure 5:
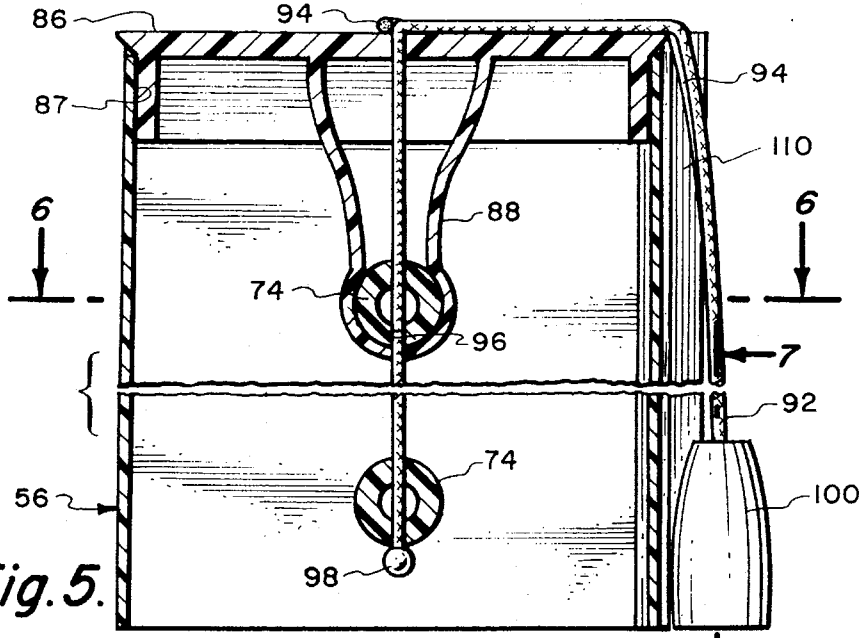
FIG. 5 is a cross sectional view taken along line 5—5 of FIG. 4.

Referring particularly to the drawings, there is shown in FIG. 1 a portion of a vertical window treatment 10. The vertical window treatment 10 includes a header 12 which includes a sheet material housing 14 within which is mounted a guide track 16. The guide track 16 has an internal channel 18. Guide track 16 is mounted within the internal chamber 20 of the housing 14. The housing 14 and the guide track 16 will be of the same length. A typical length would be the width of a window (not shown).

Frictionally mounted within the internal channel 18 is a plurality of guide rollers 22. Each guide roller 22 is basically in the shape of a disk or washer and has an internal centrally located hole 24. Mounted in engagement with the hole 24 and closely conforming thereto is a split pin 26. Split pin 26 has an enlarged head 28. The split pin 26 is split into two identical halves by means of a slit 30. The two halves of the split pin 26 are secured to the enlarged head 28. The enlarged head 28 is mounted within a recess 32 formed within the guide roller 22. The split pin 26 is to be formed of a plastic material, a plastic that permits some flexibility. The split pin 26 has an open end 34. Within the open end 34 is mounted a sharp pointed protuberance 36. The protuberance 36 is integral with the body of the split pin 26.

The split pin 26 is mounted within a sleeve 38. One end of the sleeve 38 abuts against the lower surface of the guide roller 22. The bottom end of the sleeve 38 is integral with a transverse arm 40. It is to be noted that the split pin 26 extends some spaced distance from the transverse arm 40. The reason for this is to permit the lower end of the split pin 26 to deflect slightly as is shown in phantom lines in FIG. 3. This deflection is to occur when the connecting strip 42 of a louver 44 is moved in conjunction with the protuberance 36. In order for the connecting strip 42 to pass by the protuberance 36, the lower end of the split pin 26 is forced to expand a slight distance. Once the protuberance 36 aligns with slot 46, the protuberance 36 will extend within the slot 46 thereby supporting the louver 44 relative to the split pin 26. At this particular time the split pin 26 will automatically deflect back to the closed position as shown in solid lines in FIG. 3.

The housing 14 includes a longitudinal gap area 43. The gap area 43 extends the entire longitudinal length of the header 12. It is the function of the gap area 43 to provide access for the connecting strip 42 of the louver 44 when it connects with the split pin 26.

Formed within each end of the transverse arm 40 is a hole 48. Connector 50 which has a sharp pointed protruding outer end is forcibly inserted through the hole 48 which then expands slightly and is retained in conjunction with the arm 40. The connector 50 includes a sleeve 52. The sleeve 52 has fixedly mounted therein a portion of a cord 54. It is to be understood that there are actually two separate cords 54 with each cord 54 located in alignment with one end of the transverse arms 40 and the opposite cord 54 located in alignment with the opposite end of the transverse arms 40. It is the function of the two cords 54 to connect together the support devices which include the guide rollers 22, split pins 26, sleeve 38 and transverse arms 40.

It is noticed that each cord 54 is fixedly secured to its respective sleeve 52 so there is a prescribed distance between the directly adjacent support devices when the cords 54 are taut. This distance is shown in FIG. 1. This distance is preselected according to the width of the louvers 44. The ends of the cords 54 could extend exteriorly of the header 12 and be operated by a human user. This operation would be by pulling on this portion of the cords 54 which will cause the support devices to pivot. This in turn will pivot the louvers 44 between a position in substantial alignment (not shown) where the louvers combine to form a structure similar to a solid panel and in a parallel position which is shown in FIG. 1 which forms large spaces between the louver 44, forming a structure similar to an open window so that light can enter through the window and also so a human located within the house or building can observe through the window. However, the cords 54 need not necessarily extend exteriorly of the header 12. The human user only needs to grasp one of the louvers 44, when in the position shown in FIG. 1, and by manually pivoting that louver will automatically cause all the louvers 44 to so pivot simultaneously. In other words, by the human user merely pivoting the louvers 44 from the aligned position to the parallel position shown in FIG. 1, all the louvers will also be located in that position.

Another way that the louvers 44 can be moved is by the louvers being located in the stretched out configuration shown in FIG. 1 or can be abuttingly located together at one end of the header 12. This could be merely accomplished by the human user physically moving all the louvers 44 together which will also move their respective support devices together in position with the guide rollers 22 touching each other. The louvers 44 can be moved in this position at either end of the header 12. One desirable feature of this invention shown in FIGS. 1 to 3 is that there are no cords located exteriorly of the header 12.

Referring particularly to FIGS. 4 to 7 of the drawings, there is shown a side rail 56 which is to be mounted along the side of a window, as opposed to the top of a window, which is the case for the header 12. It is to be understood that there will be two such side rails 56 mounted on opposite sides of the window. Side rail 56 is very similar in construction to the header 12 in that there is included an exterior housing 58 within which is mounted a guide track 60. The guide track 60 includes an internal channel 62. The guide track 60 is mounted within an internal chamber 64 of the housing 58. The housing 58 includes a longitudinal gap 66. A pointed connector 68, that extends from each louver 70, is force fittingly inserted within a central hole 72 formed within a sleeve 74. The lower end of the sleeve 74 is integrally connected to a transverse arm 76. The transverse arm 76 includes a pair of holes 78. A connector 80 is to connect with each hole 78.

Each connector 80 includes a sleeve 82. Fixedly mounted within each sleeve 82 is a portion of a cord 84. It is to be understood that there are two in number of the cords 84. Again it is the option of the installer to have the cords 84 extend exteriorly of the side rail 56 or to be terminated within the confines of the side rail 56. The purpose of the cords 84 would be to pivot each of the louvers 70 so that the louvers 70 can be located in an aligned position or in a parallel position with this parallel position being shown in FIG. 4. This pivoting of the louvers 70 can be accomplished by manually pivoting one of the louvers 70 which inherently will pivot all of the louvers 70.

Besides pivoting of the louvers 70, the louvers 70 are capable of being moved vertically so that all the louvers will be assembled in a group directly adjacent end cap 86. The end cap 86 is to be force fitted within the open upper end 87 of the housing 58. The sleeve 74 is to be snapped within retaining bracket 88 which is fixedly mounted to the inside surface of the end cap 86. This fixes in position the uppermost of the series of support devices, each which are attached to a louver 70. To hold the louvers 70 directly adjacent the end cap 86, that is in sequence against the uppermost of the louvers 70, there may be employed a magnet 90 mounted on each sleeve 74. Therefore, by merely manually moving each of the louvers 70 to the upper assembled position, if the magnets 90 are strong enough, each of the support devices, as well as the louvers 70, will be maintained in this position. When it is desired to move the louvers 70 to the stretched configuration shown in FIG. 4, it is only necessary to manually grasp the lowermost louver 70 and manually move these louvers to the stretched configuration.

However, instead of utilizing a manual force to move the louvers 70 to this abutting position, there may be utilized a pull cord assembly in the form of a pair of pull cords 92 and 94. There is formed a hole 96 through each sleeve 74. It is through this hole 96 that there is conducted the pull cord 92. Exteriorly of the lowermost sleeve of the series of support devices, the cord 92 is attached to a ball 98. It is the function of the ball 98 to prevent the cord 92 from becoming disengaged from the sleeves 74. The free end of the cord 92 is fixedly mounted to handle member 100. Cord 94 is fixedly mounted to handle member 102. Handle member 100 and handle member 102 connect together to form a single handle as shown in solid lines in FIG. 7. However, the handle members 100 and 102 can be separated from one another as shown in dotted lines in FIG. 7. If a small child were to become entangled between the cords 92 and 94, it is desirable that the handle members 100 and 102 will separate so that the small child will not become injured. A typical type of releasable fastener that could be employed between the handle members 100 and 102 would be a hook pad 104 which is fixedly mounted on the member 100. This hook pad 104 is to connect with an eyelet pad 106 which is fixedly mounted on the handle member 102. The eyelet pad 106 is mounted within a recess 108 formed within the handle member 102. The function of the recess 108 is so the handle members 100 and 102 are connected together and that such form a flush surface forming in essence a solid single member.

It is to be understood that by grasping the handle formed by handle members 100 and 102 and pulling in a downward direction will result in the louvers 70 being moved in an abutting assembled position located directly adjacent the retaining bracket 88. It is also to be understood that the cord 94 is to connect with a series of sleeves 74 which are located on the opposite side of the window which is not shown.

It is to be understood that the basic concept of the structure shown in FIGS. 4 to 7, though shown in relation to a blind type of window treatment, can also be used in conjunction with a shutter.

Figure 6:
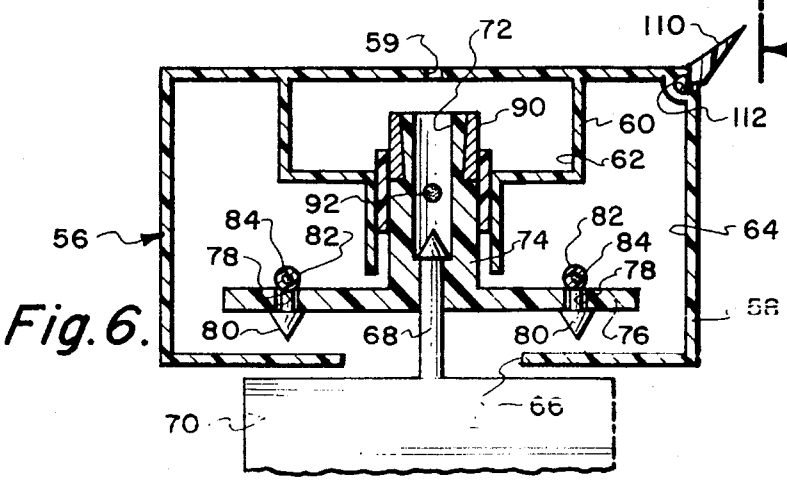
FIG. 6 is a cross sectional view taken along line 6—6 of FIG. 5.
Figure 4:
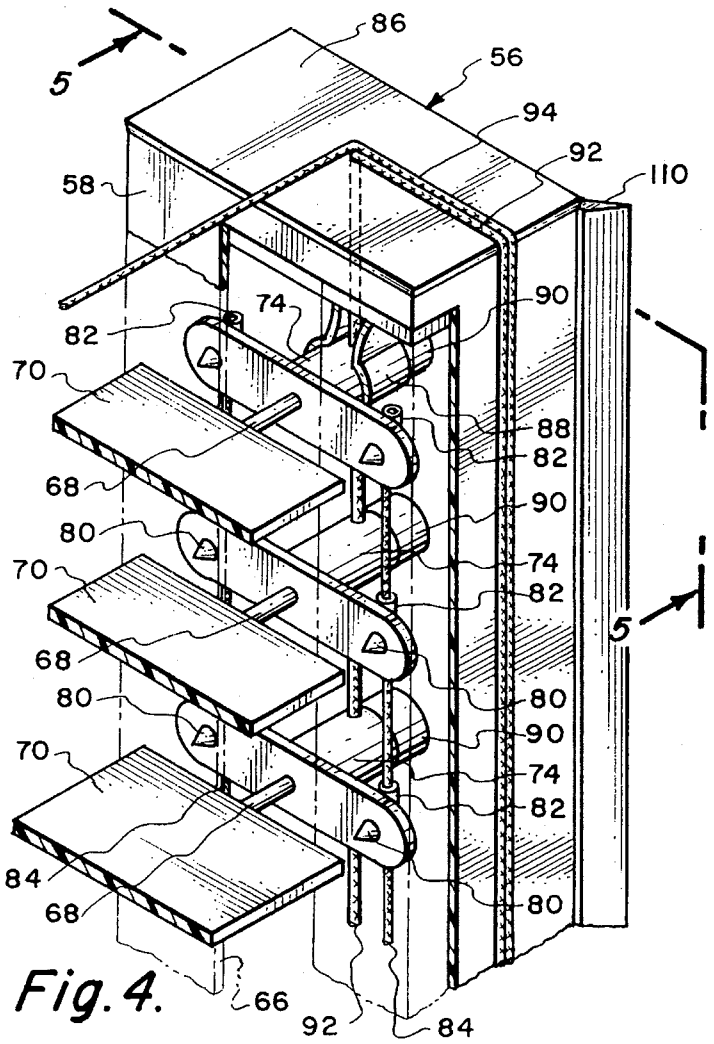
FIG. 4 is an isometric view of a portion of a blind type of window treatment utilizing the operating mechanism of the present invention.

Referring particularly to FIGS. 4 and 6 of the drawings, there is shown a wiper 110 which will normally be constructed of a rubber or plastic material. The wiper 110 is to extend the entire length of the side rail 56. The wiper 110 is mounted in conjunction with a longitudinal slot 112 formed within the housing 58. It is the function of the wiper 110 to function as a light block, that is to block the conducting of light in between the housing 58 and the window on which the housing 58 would be mounted. The conducting of light would normally be by means of the creating of a small gap between the housing 58 and the jamb of the window. The use of the wiper 110 is for the purpose of creating a more attractive in appearance window treatment.

Normally the housing 58 will include spaced-apart holes 59 which facilitate the mounting of the housing 58 to a window jamb or wall by means of typical screw fasteners extending through the holes 59 to penetrate the window jamb or wall.

What is claimed is:

1. An operating mechanism for a window treatment, said window treatment having a plurality of sheet material louvers, said louvers located in juxtaposition, said louvers being movable relative to each other from a spaced apart position to an abutting position, said louvers also being simultaneously pivotally movable between an alignment position where said louvers combine to form a structure similar to a solid panel and a parallel position forming large spaces between said louvers forming a structure similar to an open window, said operating mechanism comprising:

an elongated guide track;

a support device connected to each said louver with there being a separate said support device for each said louver forming a series of said support devices, with each said support device being mounted on said guide track, each said support device having a longitudinal sleeve from which extends a transverse arm, each said louver having a connecting stud, said connecting stud of each said louver to connect with its respective said support device;

a connecting cord assembly extending between and attached to said series of said support devices, said connecting cord assembly being movable to produce said pivotal movement of said louvers; and a pull cord assembly connected between each said support device, said pull cord assembly being operable exteriorly of said elongated guide track to move said louvers from said spaced apart position to said abutting position; and an end cap being mounted at one end of said elongated guide track, said elongated guide track being mounted in a substantially vertical direction with said louvers extending substantially horizontally, said end cap includes a retaining bracket, one of said support devices is longitudinally fixed in position by said retaining bracket.

2. The operating mechanism as defined in claim 1 wherein:

each said longitudinal sleeve of each said support device having mounted thereon a magnet, said magnets applying an attraction force between said support devices when said support devices are in said abutting position thereby tending to maintain said support devices in said abutting position.

3. The operating mechanism as defined in claim 1 wherein:

said pull cord assembly including two separate pull cords, said pull cord assembly having an outer end, a handle being mounted at said outer end, said handle composed of two separable parts with each said part being fixedly connected to a said separate pull cord, said two separable parts being separable upon the application of a force tending to separate said parts.

4. An operating mechanism for a window treatment, said window treatment having a plurality of sheet material louvers, said louvers located in juxtaposition, said louvers being movable relative to each other from a spaced apart position to an abutting position, said louvers also being simultaneously pivotally movable between an aligned position where said louvers combine to form a structure similar to a solid panel and a parallel position forming large spaces between said louvers forming a structure similar to an open window, said operating mechanism comprising:

an elongated guide track, a support device connected to each said louver with there being a separate said support device for each said louver forming a series of said support devices, each said support device being mounted within said guide track, each said support device having a longitudinal sleeve from which extends a transverse arm, a split pin is mounted within each said longitudinal sleeve, each said louver having a connecting stud, said connecting stud of a said louver connecting by connection means with a said split pin, during establishing of the connection of a said connecting stud with a said split pin said split pin to partially separate in two parts until complete connection occurs between said connection means and said connecting stud; and a connecting cord assembly extending between and attached to said series of said support devices, said connecting cord assembly being movable to produce said pivotal movement of said louvers.

5. The operating mechanism as defined in claim 4 wherein:

said connection means comprising a caming protuberance, inserting movement of said connecting stud in conjunction with a said caming protuberance causes the said split pin to partially separate into said two parts.

6. The operating mechanism as defined in claim 5 wherein:

a guide roller being mounted on each said split pin with there being a separate said guide roller for each said split pin, said guide roller to be low frictionally mounted within said guide track.

7. The operating mechanism as defined in claim 4 wherein:

a guide roller being mounted on each said split pin with there being a separate said guide roller for each said split pin, said guide roller to be low frictionally mounted within said guide track.

* * * * *